US008944674B2

(12) United States Patent
Kim et al.

(10) Patent No.: US 8,944,674 B2
(45) Date of Patent: Feb. 3, 2015

(54) HOMOGENIZING MIXER WITH AN AGITATING UNIT HAVING A LIFTER UNIT

(75) Inventors: Chung Hwan Kim, Seoul (KR); Deok Gy Cho, Suwon (KR)

(73) Assignee: Heungbo Tech Co., Ltd., Incheon (KR)

( * ) Notice: Subject to any disclaimer, the term of this patent is extended or adjusted under 35 U.S.C. 154(b) by 1098 days.

(21) Appl. No.: 12/958,709

(22) Filed: Dec. 2, 2010

(65) Prior Publication Data

US 2012/0140591 A1 Jun. 7, 2012

(51) Int. Cl.

| | |
|---|---|
| ***B01F 7/16*** | (2006.01) |
| ***B01F 5/10*** | (2006.01) |
| ***B01F 7/00*** | (2006.01) |
| ***B01F 7/18*** | (2006.01) |

(52) U.S. Cl.

CPC ..... *B01F 7/166* (2013.01); *B01F 5/104* (2013.01); *B01F 7/00116* (2013.01); *B01F 7/00141* (2013.01); *B01F 7/00633* (2013.01); *B01F 7/162* (2013.01); *B01F 7/1635* (2013.01); *B01F 7/183* (2013.01)

USPC ..... 366/195; 366/286; 366/304; 366/331

(58) Field of Classification Search

CPC ..... B01F 7/00925; B01F 7/00933; B01F 7/00941; B01F 7/0095; B01F 7/162; B01F 7/00708; B01F 5/104; B01F 15/027

USPC ..... 366/194–196, 285–286, 331, 304

See application file for complete search history.

(56) References Cited

U.S. PATENT DOCUMENTS

| | | | | | |
|---|---|---|---|---|---|
| 3,583,682 | A * | 6/1971 | Berents | 366/194 |
| 4,357,111 | A * | 11/1982 | Honemeyer et al. | 366/145 |
| 4,403,868 | A * | 9/1983 | Kupka | 366/295 |
| 4,813,786 | A * | 3/1989 | LeMaster | 366/251 |
| 5,611,619 | A * | 3/1997 | Shen | 366/296 |
| 5,779,360 | A * | 7/1998 | Tanaka | 366/286 |
| 6,866,411 | B1 * | 3/2005 | Stelzer et al. | 366/136 |
| 2007/0140054 | A1 * | 6/2007 | Stocker | 366/331 |
| 2012/0140591 | A1 * | 6/2012 | Kim et al. | 366/190 |
| 2014/0177383 | A1 * | 6/2014 | Porep | 366/286 |

* cited by examiner

*Primary Examiner* — Charles Cooley

(74) *Attorney, Agent, or Firm* — IPLA P.A.; James E. Bame

(57) ABSTRACT

Provided is a homogenizing mixer including: a container having an internal space so that materials whose properties differ are contained therein; a fixed frame that is disposed so as to be fixed at the bottom of the container, and communicates from the inside of the container; an agitating unit that is disposed in the fixed frame, so as to be lifted up and down by medium of an lifting unit, and that agitates the materials contained in the container; a driving unit that is disposed on the bottom of the agitating unit for transferring a rotational driving force for the agitating unit; and a discharging unit that is coupled to the agitating unit and discharging a homogenized material to the outside of the mixer.

6 Claims, 6 Drawing Sheets

HOMOGENIZING MIXER WITH AN AGITATING UNIT HAVING A LIFTER UNIT

BACKGROUND OF THE INVENTION

1. Field of the Invention

The present invention relates to a homogenizing mixer that mixes and homogenizes a liquid-phase material that is a raw material with another liquid-phase material or powder material whose property differs from that of the raw material.

2. Description of the Related Art

In general, homogenizing mixers are chiefly used for manufacturing cosmetics or paints, and play a role of mixing a raw material and a blend material both properties of which differ from each other with a viscous material, to thereby perform a function of homogenizing the mixture.

Here, both the raw material and the blend material may be liquid-phase materials, or a mixture or a liquid-phase material and a minute powder material.

A conventional homogenizing mixer includes a substantially hemispherical tubular container, an agitator, a driving unit that driving units the agitator, and a main body frame.

The container is a vessel that is chiefly formed in a cylindrical form, and may be heated and cooled by a jacket depending on a processing purpose thereof, and may be processed under the vacuum or pressurized state.

The container is classified into a fixed type, an exchangeable type and a tilting type, according to a handling method thereof.

The driving unit includes a motor and a reduction gear. The agitator is disposed below the driving unit. The agitator includes a stator rod (SR), a turbine shaft (TS), impeller that is connected to the turbine shaft (TS) and rotates at high-speed, and an agitation barrel that is fixed to the stator rod (SR).

The agitator having the above-described structure is rotated at high speed by the driving unit, and mixes and homogenizes a liquid-phase material, a viscous material, and a powder material, all of which are contained in the vessel of the container.

Since the conventional homogenizing mixer is configured so that the agitator and the driving unit are activated at the upper side of the container, there are problems that configurational facilities necessary to operate the agitator and the driving unit are complicated and overloaded.

SUMMARY OF THE INVENTION

To solve the above problems of the conventional art, it is an object of the present invention to provide a homogenizing mixer whose structure is improved so as to rotate and lift an agitator during agitating materials that are put in a container, and have a simply lifting structure and a structure of conveniently discharging homogenized materials.

To achieve the above object of the present invention, there is provided a homogenizing mixer comprising:

a fixed frame that is disposed so as to be fixed at the bottom of a container, and communicates from the inside of the container;

an agitating unit that is disposed in the fixed frame so as to be lifted up and down by medium of a lifting unit, and that agitates materials contained in the container;

a driving unit that is disposed on the bottom of the agitating unit for transferring a rotational driving force for the agitating unit; and a discharging unit that is stirred by the agitating unit and discharging a homogenized material to the outside of the mixer.

A homogenizing mixer according to the present invention uses an agitating unit that can be lifted at the lower portion of a container, to thus homogenize a plurality of materials whose properties differ from each other. Accordingly, the agitating unit becomes simplified, to thus save cost, reduce failure factors, and conveniently discharge homogenized materials in conjunction with a descending operation of the agitating unit, without having a separate discharging unit. As a result, the homogenizing mixer according to the present invention does not only have a simple structure but also functions conveniently.

BRIEF DESCRIPTION OF THE DRAWINGS

The above and other objects and advantages of the present invention will become more apparent by describing the preferred embodiment thereof in more detail with reference to the accompanying drawings in which.

DETAILED DESCRIPTION OF THE INVENTION

Figure 1:
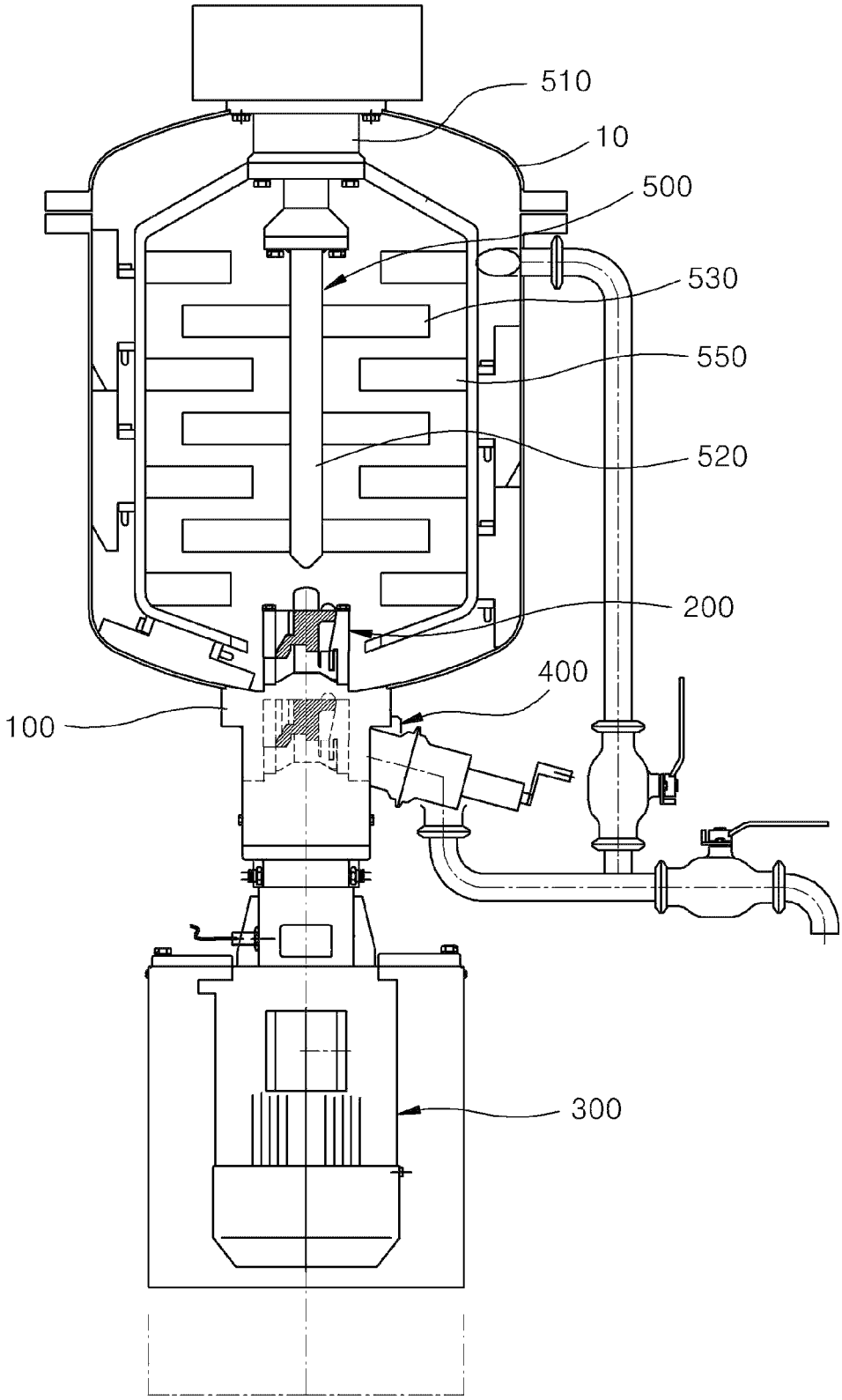
FIG. 1 is a cross-sectional view showing structure of a homogenizing mixer according to the present invention.
Figure 2:
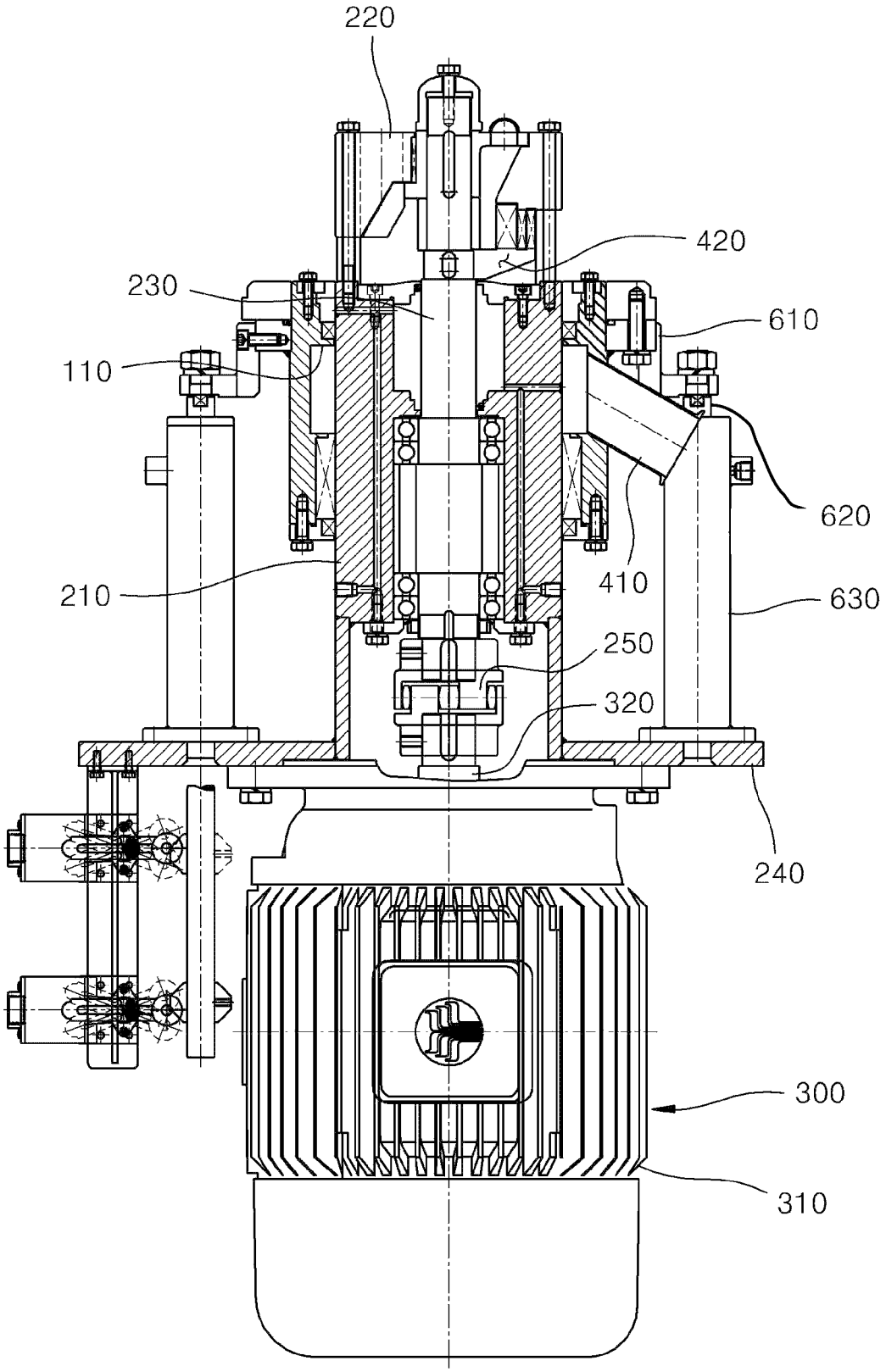
FIG. 2 is a cross-sectional view showing a state of using a homogenizing mixer where an lifting unit is turned off and thus an impeller is ascended in the homogenizing mixer according to the present invention.
Figure 3:
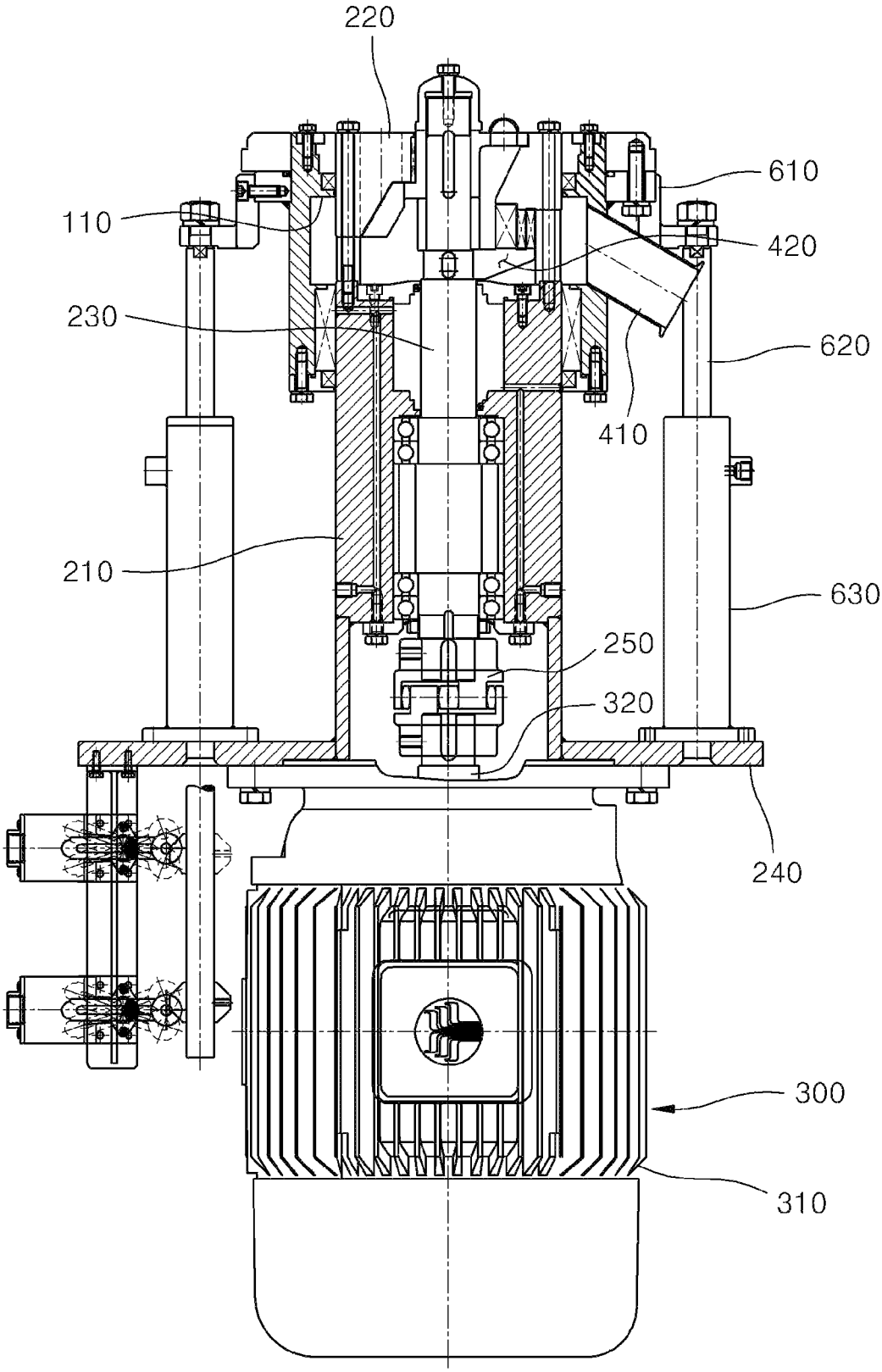
FIG. 3 is a cross-sectional view showing a state of using a homogenizing mixer where an lifting unit is turned on and thus an impeller is descended in the homogenizing mixer according to the present invention.
Figure 4:
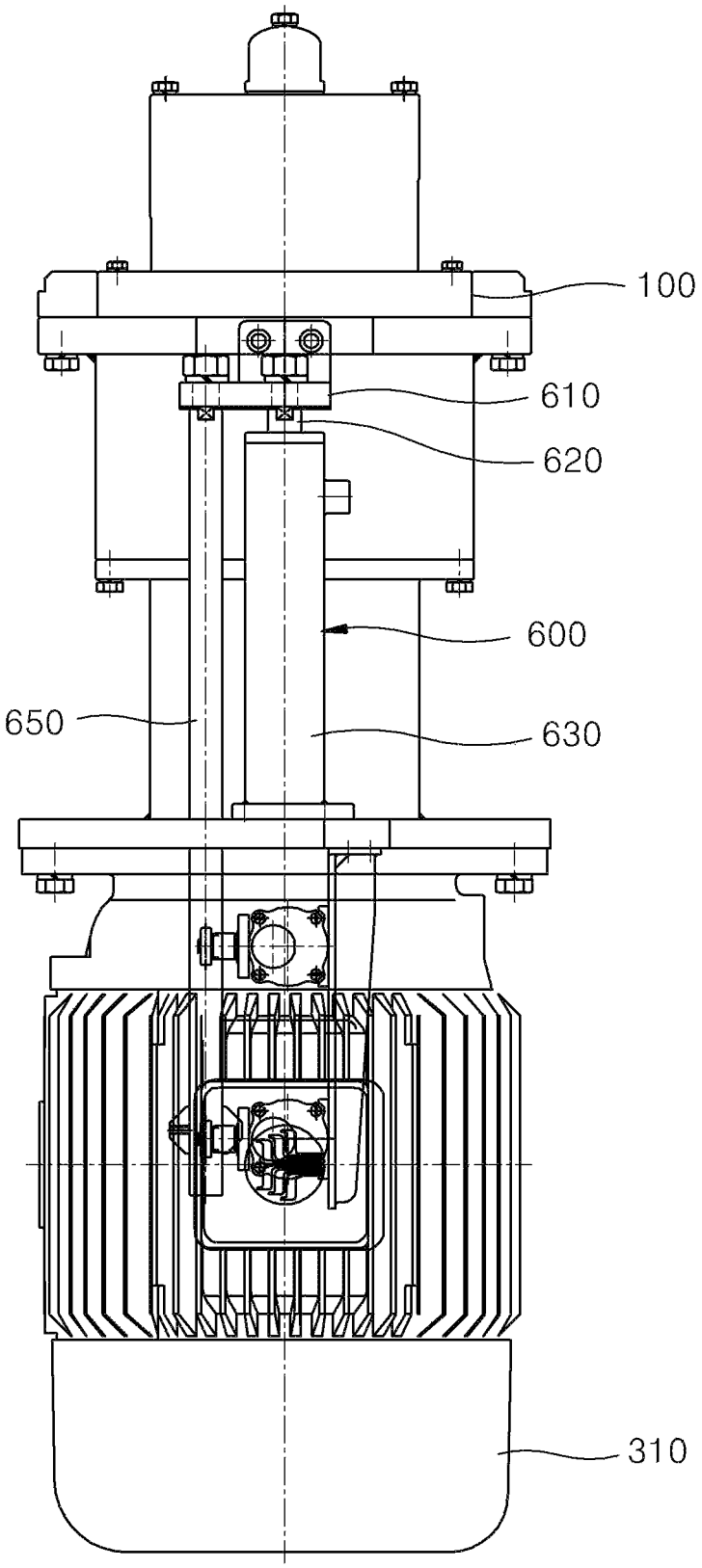
FIG. 4 is a side view showing a homogenizing mixer according to the present invention.
Figure 5:
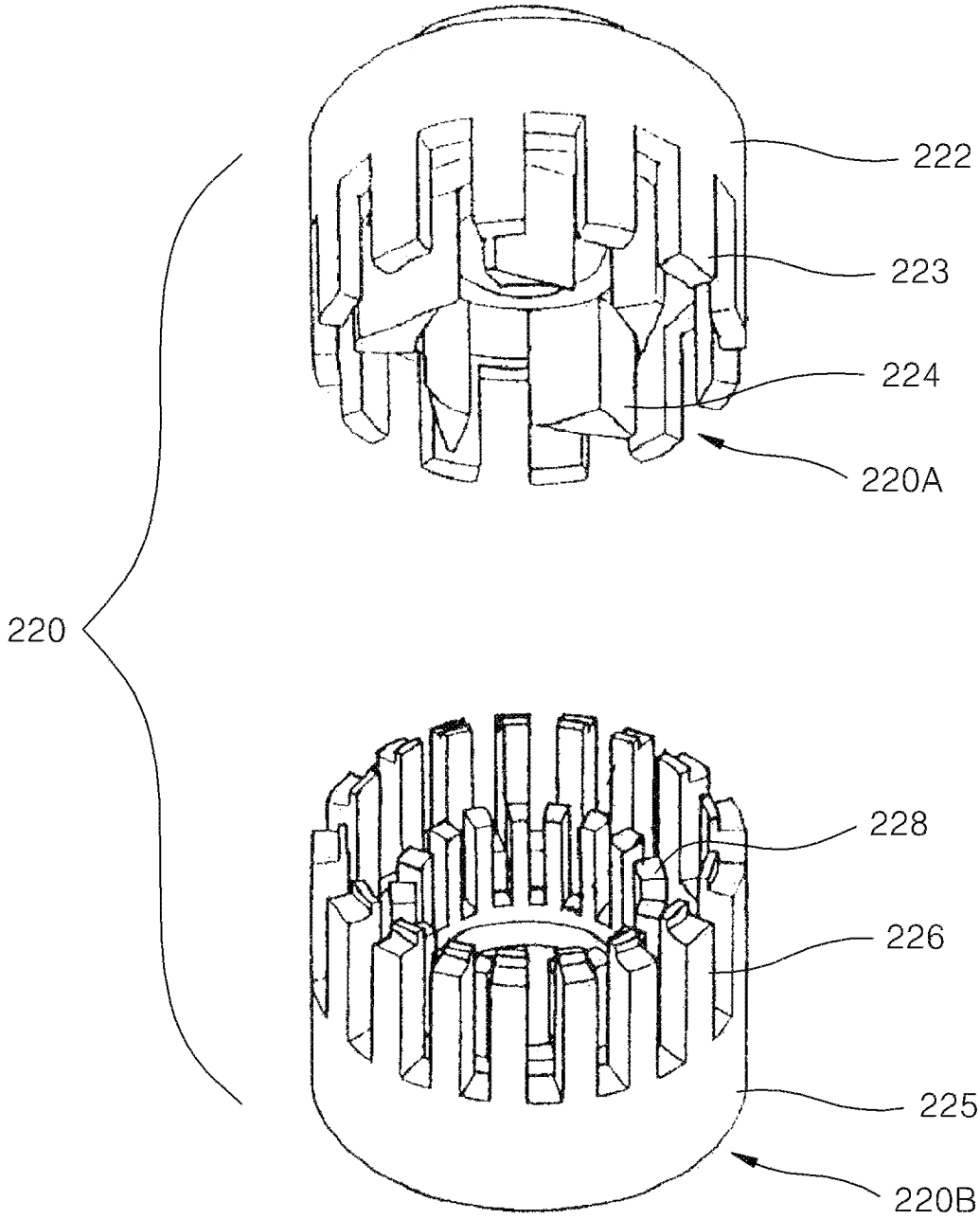
FIG. 5 is a perspective view showing a disassembled impeller that is applied in a homogenizing mixer according to the present invention.
Figure 6:
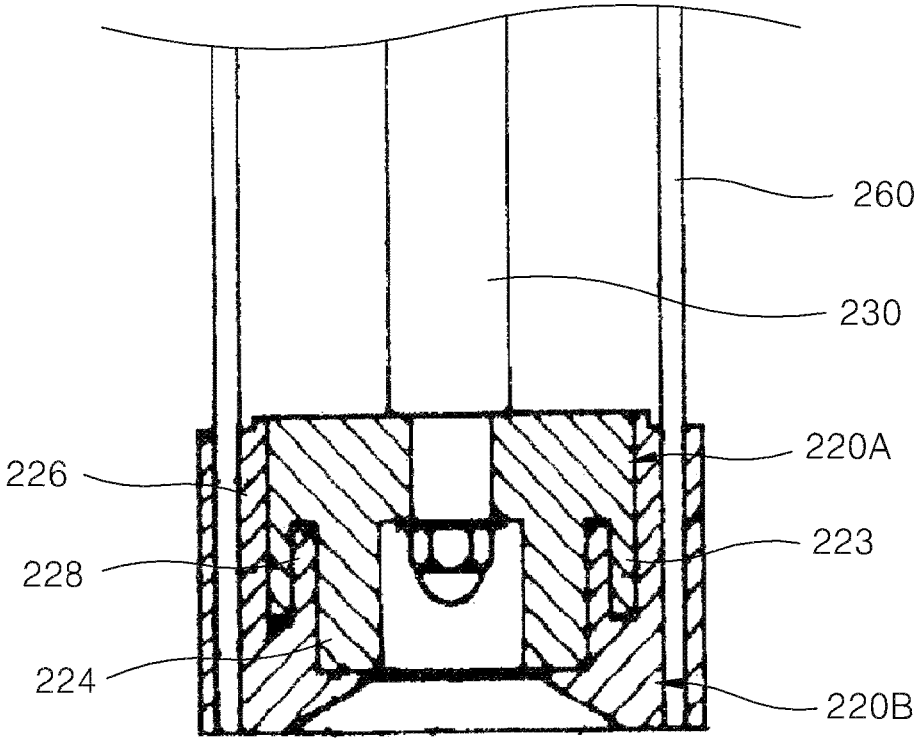
FIG. 6 is a cross-sectional view showing an assembled impeller that is applied in a homogenizing mixer according to the present invention.

A homogenizing mixer according to a preferred embodiment of the present invention will be described with reference to the accompanying drawings, FIGS. 1 to 6.

Referring to FIGS. 1 to 6, a homogenizing mixer according to a preferred embodiment of the present invention, includes: a container 10 having an internal space so that materials whose properties differ are contained therein; a fixed frame 100 that is disposed so as to be fixed at the bottom of the container 10, and communicates from the inside of the container 10; an agitating unit 200 that is disposed in the fixed frame 100, so as to be lifted up and down by medium of an lifting unit, and that agitates the materials contained in the container 10; a driving unit 300 that is disposed on the bottom of the agitating unit 200 for transferring a rotational driving force for the agitating unit 200; and a discharging unit 400 that is stirred by the agitating unit 200 and discharging a homogenized material to the outside of the mixer.

In more detail, the fixed frame 100 is connected to the center of the bottom of the container 10 so as to communicate downwards from the container 10, and is formed of a cylindrical structure.

A drainage tube 410 for draining homogenized materials in the container 10 to the outside of the container 10 is connected to the fixed frame 100. The drainage tube 410 is slantingly disposed downwards at the lower portion of the fixed frame 100. The drainage tube 410 is closed and opened by a drain valve (not shown) that is placed in the inside of the drain tube. The agitating unit 200 includes: a moving frame 210 that is disposed in the inside of the fixed frame 100 so as to be lifted; an impeller 220 that is rotatably disposed in the moving frame 210 and has a number of blades; an agitating shaft 230 that is coupled with the impeller 220 and is connected with the driving unit 300, to thereby provide a rotational force; and a coupling unit 250 that is disposed between the agitating shaft 230 and the driving unit 300, and transfers the rotational force for the agitating shaft 230.

The moving frame 210 is disposed in the inside of the fixed frame 100 that is fixed to the lower portion of the container 10, and has an ascending and descending structure that the moving frame 210 can be lifted through the medium of the lifting unit 600. The lifting unit 600 has two lifters that are disposed at both sides of the agitating unit 200. Each lifter includes: a fixed plate 610 that is coupled to extend horizontally at the lower portion of the fixed plate 610; a rod member 620 that is fixed on both sides of the fixed plate 610 so as to be expanded and contracted; and a cylinder 630 that is coupled to be fixed to a connecting plate 240 that is integrally connected to the moving frame 210 and that is connected with the rod member 620 to provide an elastic force.

In addition, each lifter of the lifting unit 600 further includes a guide rod member 650 whose upper end is penetratatively coupled with the fixing plate 610 to guide the rod member 620 and the moving frame 210 to ascend and descend, and whose lower end is penetratatively coupled with the connecting plate 240.

The driving unit 300 includes; a driving motor 310 that is disposed at the lower portion of the moving frame 210 and is rotationally driven as external electric power is applied thereto; and a motor shaft 320 that is rotated by the rotational driving power of the driving motor 310 and that is connected to operate together with the agitating shaft 230 through the medium of the coupling unit 250. The coupling unit 250 plays a role of connecting the agitating shaft 230 and the motor shaft 320, and thus has a structure of mutually engaging a plurality of gear teeth that are protrudingly formed in the agitating shaft 230 and the motor shaft 320 so as to correspond to each other.

In addition, the driving motor 310 is fixed to the connecting plate 240 that is fixed to the moving frame 210 so as to be linked with the moving frame 210 to thus be lifted up and down. In other words, the connection plate 240 has a coupling structure that the connection plate 240 is integrally fixed to the driving motor 310 through the medium of engagement members such as bolts and nuts at the lower portion of the moving frame 210. A plurality of bearings are disposed between the agitating shaft 230 and the moving frame 210. The discharging unit 400 includes: a drainage tube 410 that is disposed at the lower portion of the moving frame 210, and is connected to the outside of the mixer; and a space portion 420 that is formed between the fixed frame 100 and the moving frame 210, for discharging the homogenized material to and through the drainage tube 410 during a descending operation of the moving frame 210 by the lifting unit 600. The space portion 420 is formed since the outer diameter of the upper portion of the moving frame 210 is smaller than the hollow inner diameter of the fixed frame 100.

The fixed frame 100 includes a stopper 110 that is protruded inwards at the hollow upper portion thereof. The stopper 110 plays a role of interrupting materials contained in the container 10 from being discharged to the outside of the mixer, in the case that the moving frame 210 is located at the position of the top dead center. In other words, the hollow inner diameter of the fixed frame 100 in which the stopper 110 has been formed corresponds to the outer diameter of the moving frame 210, the materials contained in the container 10 is prevented from being discharged through the discharging unit 400 formed at the lower portion of the container 10, at the time when the moving frame 210 ascends, on the one hand, and the materials contained in the container 10 is easily transferred into the space portion 420, at the time when the moving frame 210 descends, on the one hand.

Preferably, the homogenizing mixer according to the present invention further includes an upper agitator 500 that is accommodated in the container 10 and is vertically disposed downwards from and on the ceiling of the container 10, to thereby stir materials charged in the container 10.

The upper agitator 500 includes: a rotating shaft 520 that is directed from the inner ceiling of the container 10 to the inner portion of the container 10; and a plurality of agitation blades 530 that are disposed to have a different height from each other on the outer circumference of the rotating shaft 520. The rotating shaft 520 has a connection structure that the rotating shaft 520 is rotated together with operation of an upper motor 510. A reduction gear can be disposed in the middle of the rotating shaft 520. The upper motor 510 operates in conjunction with of the driving motor 310.

More preferably, the homogenizing mixer according to the present invention further includes a plurality of fixed blades 550 that are protrudingly formed from the inner wall of the container 10 and are positioned to be spaced apart from each other. The fixed blades 550 are disposed between a plurality of the agitation blades 530, respectively, in order to improve an agitation efficiency of materials that have been put into the container 10. The impeller 220 according to the present invention can adopt a variety of forms, but can adopt a double structure impeller 220 to improve the agitation efficiency.

The impeller 220 includes: a rotating impeller 220A that is coupled with one end of the agitating shaft 230 and is rotated together with operation of the agitating shaft 230; and a fixed impeller 220B that is fitted into and coupled with the rotating impeller 220A and fixed to an agitation housing 260 through the medium of a fixing unit. The rotating impeller 220A includes: a hollow cylindrical body 222; a plurality of outer blade members 223 that are formed on the outer circumference of the cylindrical body 222 and are spaced apart from each other; and a plurality of inner blade members 224 that are formed to be spaced apart inwards from the outer blade members 223 and whose cross-section have a triangular shape, respectively. The fixed impeller 220B includes: a hollow cylindrical body 225; a plurality of outer fin members 226 that are protrudingly formed from the outer edge of the cylindrical body 225 and that enclose the outer blade members 223 when the fixed impeller 220B is coupled with the rotating impeller 220A; and a plurality of inner fin members 228 that are formed to be spaced apart inwards from the outer fin members 226 and are disposed in a space formed between the outer blade members 223 and the inner blade members 224 when the fixed impeller 220B is coupled with the rotating impeller 220A.

The homogenizing mixer having the above-described configuration according to the present invention will follow.

The homogenizing mixer according to the present invention accommodates a raw material and a blend material both properties of which differ from each other in an inner space of a container 10, and then stirs and homogenizes the materials charged in the container 10 using an agitating unit 200. Here, an impeller 220 and a moving frame 210 both of which are included in the agitating unit 200 is placed at an elevated position from the bottom of the container 10. The impeller 220 receives a rotational force that is transferred from the driving unit 300 via an agitating shaft 230 of the agitating unit 200, and is rotated together with operation of the agitating shaft 230, to thereby make blades formed on the impeller 220 stir the materials contained in the container 10.

According to a power transmission process of the driving unit 300, the rotational force of the driving motor 310 is transferred to the agitating shaft 230 through a motor shaft 320 and a coupling unit 250, and the impeller 220 that is coupled at the end of the agitating shaft 230 is rotated together with operation of the agitating shaft 230. After the materials contained in the container 10 has been completely agitated, a discharging operation for discharging the agitated materials to the outside of the container 10 is performed. In the discharging operation, the lifting unit 600 makes the moving frame 210 and the impeller 220 descend, and thus forms a space portion 420 between the hollow inner portion of the fixed frame 100 and the outer diameter of the moving frame 210. If the space portion 420 has been formed, the agitated materials contained in the container 10 are discharged through the space portion 420 and the drainage tube 420 by the force of gravity.

During operation of the lifting unit 600, an air or hydraulic oil pressure is applied into the inside of a cylinder 630 at the state where an end of a rod member 620 is fixed to the fixed frame 610. Accordingly, in the case that the rod member 620 is extended, a connecting plate 240 that is connected with the moving frame 210 descends, and then both the moving frame 210 and the impeller 220 descend.

If the space portion 420 has been formed, the materials contained in the container 10 are discharged to the outside of the container 10 through the space portion 420 and the drainage tube 410. In this case, a drainage valve (not shown) may be turned on in order to open the drainage tube 410. In contrast, in the case that the rod member 620 is contracted at the state where the end of the rod member 620 is fixed to the fixed frame 610, the moving frame 210 ascends within the fixed frame 100, to thus interrupt the agitated materials from being discharged.

Thereafter, after discharging, new materials are put into and agitated in the container 10, in order to execute a homogenizing mixing work repeatedly.

Meanwhile, in the case that the above-mentioned double structure impeller 220 is employed in a homogenizing mixer according to the present invention, the double structure impeller 220 is rotated at the state where a rotating impeller 220A coupled with the agitating shaft 230 is fitted with a fixed impeller 220B fixed on an agitation housing 260. Here, since a plurality of inner fin members 228 of the fixed impeller 220B are disposed in a space formed between a plurality of outer blade members 223 and inner blade members 224 of the rotating impeller 220A, an agitating performance of the materials contained in the container 10 can be enhanced.

The upper agitator 500 according to the present invention is rotated in the inside of the container 10 so that a plurality of agitating blades 530 are crossed with a plurality of fixed blades 550.

In addition, the upper agitator 500 is disposed at the bottom of the container 10, and thus is operated in conjunction with the impeller 220 and the agitating shaft 230 both of which descend and ascend. Accordingly, an agitating performance of the materials charged in the container 10 can be enhanced. In other words, since an agitating operation is accomplished in the upper and lower portions of the container 10, a homogenized mixing operation of materials contained in the container cannot be only achieved within a short time, but also the materials contained in the container can be uniformly agitated to thereby enhance an agitating performance greatly.

Although the present invention has been described in detail with respect to the limited embodiments and drawings, it is not limited thereto. It is apparent to one who has an ordinary skill in the art that there may be a number of modifications and variations within the same technical spirit of the invention. It is natural that the modifications and variations belong to the following appended claims.

What is claimed is:

1. A homogenizing mixer comprising:

a fixed frame that is disposed so as to be fixed at the bottom of a container, and communicates from the inside of the container;

an agitating unit that is disposed in the fixed frame so as to be lifted up and down by medium of a lifting unit, and that agitates materials contained in the container;

a driving unit that is disposed on the bottom of the agitating unit for transferring a rotational driving force for the agitating unit; and a discharging unit that is coupled to the agitating unit and discharging a homogenized material to the outside of the mixer, wherein the agitating unit comprises:

a moving frame that is disposed in the inside of the fixed frame so as to be lifted;

an impeller that is rotatably disposed in the moving frame and has a number of blades;

an agitating shaft that is coupled with the impeller and is connected with the driving unit, to thereby provide a rotational force; and a coupling unit that is disposed between the agitating shaft and the driving unit, and transfers the rotational force for the agitating shaft, wherein the impeller comprises:

a rotating impeller having a hollow cylindrical body, so as to be coupled with one end of the agitating shaft, a plurality of outer blade members that are formed on the outer circumference of the cylindrical body and are spaced apart from each other, and a plurality of inner blade members that are formed to be spaced apart inwards from the outer blade members and whose cross-section have a triangular shape, respectively; and a fixed impeller having a hollow cylindrical body, so as to be coupled with the rotating impeller, a plurality of outer fin members that are protrudingly formed from the outer edge of the cylindrical body and that enclose the outer blade members when the fixed impeller is coupled with the rotating impeller, and a plurality of inner fin members that are formed to be spaced apart inwards from the outer fin members and are disposed in a space formed between the outer blade members and the inner blade members when the fixed impeller is coupled with the rotating impeller.

2. The homogenizing mixer according to claim 1, wherein each lifter of the lifting unit comprises:

a fixed plate;

a rod member that is fixed on both sides of the fixed plate so as to be expanded and contracted; and a cylinder that is coupled to be fixed to a connecting plate that is integrally connected to the moving frame and that is connected with the rod member to provide an elastic force.

3. The homogenizing mixer according to claim 1, wherein the discharging unit comprises: a drainage tube that is disposed at the lower portion of the moving frame, and is connected to the outside of the mixer; and a space portion that is formed between the fixed frame and the moving frame, for discharging the homogenized material to and through the drainage tube during a descending operation of the moving frame.

4. The homogenizing mixer according to claim 1, wherein the driving unit comprises: a motor shaft that is connected to operate together with the agitating shaft through the medium of the coupling unit; and a driving motor that is connected with the motor shaft and is integrally fixed to the moving frame.

5. The homogenizing mixer according to claim 1, further comprising an upper agitator that is accommodated in the container and is vertically disposed downwards from and on the ceiling of the container, to thereby stir materials charged in the container.

6. The homogenizing mixer according to claim 5, further comprising a plurality of fixed blades that are protrudingly formed from the inner wall of the container and are positioned to be spaced apart from each other.

* * * * *